United States Patent [19]

Tamai et al.

[11] 4,063,946

[45] Dec. 20, 1977

[54] ELECTROPHOTOGRAPHIC COLOR REPRODUCTION PROCESS EMPLOYING PHOTOCONDUCTIVE MATERIAL WITH DUAL LIGHT FATIGUE PROPERTIES

[75] Inventors: Yasuo Tamai; Sadao Osawa, both of Tokyo, Japan

[73] Assignee: Rank Xerox Ltd., London, England

[21] Appl. No.: 325,283

[22] Filed: Jan. 22, 1973

[51] Int. Cl.[2] ..... G03G 13/01; G03G 5/12

[52] U.S. Cl. ..... 96/1.2; 96/1.5R; 96/1.6

[58] Field of Search ..... 96/1.2, 1.3

[56] References Cited

U.S. PATENT DOCUMENTS

| | | | |
|---|---|---|---|
| 2,756,676 | 7/1956 | Steinhilper | 96/1.3 X |
| 3,038,799 | 6/1962 | Metcalfe et al. | 96/1.3 X |
| 3,060,019 | 10/1962 | Johnson et al. | 96/1.2 |
| 3,060,020 | 10/1962 | Greig | 96/1.2 |
| 3,060,021 | 10/1962 | Greig | 96/1.2 |
| 3,060,051 | 10/1962 | Johnson et al. | 96/1.2 X |
| 3,150,976 | 9/1964 | Johnson | 96/1.2 |
| 3,458,309 | 7/1969 | Gaynor | 96/1.2 |
| 3,630,729 | 12/1971 | Bach et al. | 96/1.2 |
| 3,667,841 | 6/1972 | Ross | 96/1.2 X |
| 3,702,483 | 11/1972 | Fantuzzo | 96/1.2 X |

FOREIGN PATENT DOCUMENTS

| | | | |
|---|---|---|---|
| 39-6650 | 5/1964 | Japan | 96/1.3 |

OTHER PUBLICATIONS

Cassiers, "Memory Effects in Electrophotography", *Journal of Photographic Science,* vol. 10, 1962, pp. 57–64.

*Primary Examiner*—David Klein
*Assistant Examiner*—John R. Miller

[57] ABSTRACT

A xerographic color reproduction imaging system is disclosed. This color system provides at least a two color image with one exposure and avoids the necessity of employing a registration step. A sensitized photoconductive layer is employed which is charged, selectively exposed and developed with a color toner. The photoconductive layer is then recharged and developed with toner of another color.

4 Claims, No Drawings

ELECTROPHOTOGRAPHIC COLOR REPRODUCTION PROCESS EMPLOYING PHOTOCONDUCTIVE MATERIAL WITH DUAL LIGHT FATIGUE PROPERTIES

This invention relates to electrophotography and more specifically to producing color reproductions in electrophotography or xerography.

The conventional xerographic imaging process employs a photoconductive imaging member which is charged to a suitable voltage and then selectively exposed to produce a latent electrostatic image. This latent electrostatic image may then be developed by applying electroscopic marking material, referred to in the art as toner, employing conventional techniques resulting in a visible image. This image may then be fused in situ or transferred or employed in a number of various operations.

The basic electrophotographic process may be employed to produce color reproductions of an original by employing the same basic techniques with color toners. Such color reproduction using xerographic techniques includes multiple procedures as above described repeated for each color. One such color electrophotographic imaging system employs multiple exposure steps to obtain the color image through various color filters and then multiple development steps with complementary colors to such color separation images. The developed color images thus produced may either be fused after each development step or fused after the last development step. However, it is critical in any process employed that the registration of each image as provided be done exactly and correctly,, thus, registration of the individual images becomes quite a critical consideration to obtaining a clear reproduction of the original. In addition, the photoreceptor in multiply charging, exposing and developing must be cleaned very thoroughly so that true image reproduction of the color separations is obtained. Accordingly, there is a demonstrated continuing need to develop xerographic color reproduction techniques which are less complicated, less time-consuming and embrace lss criticalities to produce color reproductions.

It is, therefore, an object of this invention to provide a color xerographic reproduction imaging process which is devoid of the above-noted deficiencies.

A further object of this invention is to provide a xerographic color reproduction imaging process which provides color reproductions of originals employing only a single exposure step.

Yet, another object of this invention is to provide a xerographic color reproduction imaging system which results in at least a two color image without employing a registration imaging step.

Still another object of this invention is to provide a novel xerographic color reproduction imaging process.

Again, another object of this invention is to provide a xerographic color reproduction imaging process which eliminates the need for employing color filters.

These and other objects are accomplished in accordance with the general description of the instant invention, hereinafter more specifically described by uniformly charging in the dark the surface of a photoconductive layer sensitized to respond to light in a wavelength range extended beyond the natural sensitivity zone of the respective photoconductive layer, exposing the uniformly charged photoconductive surface selectively to light having wavelengths both in the inherent and the extended photosensitive range of the sensitized photoconductive layer. In the extended wavelength range, developing the electrostatic latent image produced by this exposure with a first colored toner, charging the surface of the photoconductive layer again and then developing the second electrostatic image with a second colored toner. Thus, a color image comprising at least two colors is produced with only a single exposure step and without resort to the color filter separation techniques or registration techniques.

The photoconductive material employed in the instant invention is first sensitized to respond to light in a wavelength range extended beyond the natural sensitivity range of the instant photoconductive layer which is generally in the visual range. Sensitization is normally accomplished by employing sensitizing dyes as is well-known in the art or by applying dopants. The sensitized photoconductive material, for example, selenium doped with either of arsenic, antimony, bismuth, or tellurium, is either by itself or mixed with an insulating resin applied to a support to form a sensitized photoconductive layer. The layer is then uniformly charged with a corona in the dark and then selectively illuminated by light in the wavelength corresponding to the natural sensitivity range of the photoconductive layer. The exposed area of the photoconductive surface exposed to light of a wavelength to which the photoconductive surface is naturally sensitive without sensitization retains its reduced resistivity or acquired conductivity for a significant period of time and is therefore incapable of being charged by corona again. This is commonly referred to as light fatigue. The electrostatic charge on the photoconductive surface may also be discharged by illumination of light within the extended wavelength range which is beyond the natural sensitivity range of the photoconductive layer. In this case, it is found that light fatigue does not occur and therefore the portion of the photoconductive surface illuminated by light within the sensitized or extended wavelength range beyond the natural sensitivity range of the photoconductor layer is still capable of being charged when exposed to corona charging. Further, it is found that light fatigue also occurs in the photoconductive surface when exposed to illumination by light in the natural sensitivity range of the photoconductive layer and also to illumination by light in the sensitized or extended wavelength range beyond the natural sensitivity range of the photoconductive layer due to the illumination having a wavelength in the natural sensitivity range. The instant process employs this described property of the sensitized photoconductive layer. This is accomplished by first uniformly charging in the dark the surface of a photoconductive layer sensitized to respond to light in a wavelength extended beyond the natural sensitivity range with respect to the photoconductive layer, and exposing the uniformly charged photoconductive surface to illumination pattern produced by illumination of an original by light having wavelengths both in the inherent and in the extended wavelength range above described, developing the electrostatic latent image thus formed on the photoconductor surface with a first dye colored toner, exposing the entire surface of the photoconductive layer to a uniform charging level thereby selectively charging the photoconductive surface in pattern areas which have been exposed to the light within the extended wavelength range and not those portions of the photoconductor formerly discharged by light of a wavelength which falls in the natural sensitivity range of the photoconductor and then developing the electrostatic latent image thus formed on the photoconductive surface with a second dye colored toner thereby producing two color image reproduction.

A preferred embodiment of the process of the instant invention employing liquid development would include the following steps: uniformly charging a photoconductive surface in the dark; exposing the uniformly charged photoconductive surface to an illuminated pattern thereby producing an electrostatic latent image; developing the electrostatic latent image through a liquid development process; charging the developed photoconductive surface again and developing the recharged photoconductive surface employing a liquid development system.

The colors and sequence employed may vary according to the requirements and effects to be achieved. For example, the first color may be black and the second red, blue, green, yellow or other colors which selectively absorb the light in the visible range.

Charging of the photoconductive surface may be accomplished as above described by corona although any other suitable method of charging may be employed, for example, charge deposition resulting from air breakdown in the gap commonly referred to as TESI or charging in vacuo with an electron gun.

Any suitable method of exposure may be employed in the process of the instant invention. Typical methods of exposure include: reflex, contact, holographic techniques, non-lens slit scanning system, and optical projection systems involving lens imaging of opaque-reflection subjects as well as transparent film originals.

Any suitable development system may be employed in the process of the instant invention. Development of the second image may be accomplished with the same or another developing process. Any suitable development system alone or in combination may therefore be employed to develop the first and second images provided. Typical development systems include: cascade development, magnetic brush development, powder cloud development and liquid development. Of these the preferred method of development for both development in the first and second electrostatic images is liquid development since liquid development assures easy fixing as well as the ability to develop the first color and then readily be charged again and develop the second image with a different colored toner.

Any suitable method of fixing may be employed in the process of the instant invention. Typical method of fixing include: heat-pressure fusing, radiant fusing, combination radiant, conductive and convection fusing, cold pressure fixing and flush fusing.

Any suitable toner material or liquid developer composition may be employed in the process of the instant invention. The selected colorant may be combined with any typical resin including: thermoplastics including olefin polymers such as polyethylene and polypropylene; polymers derived from dienes such as polybutadiene, polyisobutylene, and polychloroprene; vinyl and vinylidine polymers such as polystyrene, styrene butylmethacrylate copolymers, styrene-acrylonitrile copolymers, acrylonitrile-butadiene-styrene terpolymers, polymethyl-methacrylate, polyacrylates, polyvinyl alcohol, polyvinylchloride, polyvinylcarbazole, polyvinylethers, and polyvinyl ketones, fluorocarbon polymers such as polytetrafluoroethylene and polyvinylidene fluoride; heterochain thermoplastics such as polyamides, polyester, polyurethanes, polypeptides, casein, polyglycols, polysulfides, and polycarbonates; and cellulosic polymers such as regenerated cellulose, cellulose acetate and cellulose nitrate.

Any suitable inorganic or organic photoconductor may be used in the process of the present invention. Typical inorganic photoconductor materials are: sulfur, selenium, zinc sulfide, zinc oxide, zinc cadmium sulfide, zinc magnesium oxide, cadmium selenide, zinc silicate, calcium-stronitium sulfide, cadmium sulfide, indium trisulfide, gallium triselenide, arsenic disulfide, arsenic trisulfide, arsenic triselenide, antimony trisulfide, cadmium sulfo-selenide and mixtures thereof. Typical organic photoconductors are: triphenylamine; 2,4,-bis(4,4'-diethyl-aminophenyl)-1,3,4-oxadiazol; N-isopropylcarbazole triphenylpyrrol; 4,5-diphenylimidazolidinone; 4,5-diphenylimidazolidinethione; 4,5-bis-(4'-amino-phenyl)-imidazo-lidinone; 1,5-dicyanonaphthalenel 1,4-dicyanonaphthalene; aminophthalodinitrile; nitrophthalodinitrile; 1,2,5,6-tetraaza-N-isopropylcarbazole triphenylpyrrol; 4,5-diphenylimidazolidinone; 4,5-diphenylimidazolidinethione; 4-5-bis-(4'-amino-phenyl)-imidazolidione; 1,5-dicyanonaphthalene; 1,4-dicyanonaphthalene; aminophthalodinitrile; nitrophthalodinitrile; 1,2,5,6-tetraazacycloyclootatetraene-(2,4,6,8); 2-mercapto-benzthiazole; 2-phenyl-4-diphenylidene-oxazolone; 6-hydroxy-2,3-di(p-methoxy-phenyl)-benzofurane; 4-dimethyl-amino benzylidene-benzhydrazide; 3-benzylidene-amino-carbazole; polyvinyl carbazole; (2-nitrobenzylidene)-p-bromo-aniline; 2,3-diphenyl quinazoline; 1,2,4-triazine; 1,5-diphenyl-3-methyl-pyrazoline; 2-(4'-dimethylaminophenyl)-benzoxazole; 3-aminocarbazole; phthalocyanines; trinitrofluorenone; polyvinylcarbazole; charge transfer complexes and mixtures thereof.

To further define the specifics of the present invention the following examples are intended to illustrate and not limit the particulars of the present system. Parts and percentages are by weight unless otherwise specified.

EXAMPLE I

A selenium photoconductor is doped with arsenic to extend its spectral response beyond 6,000 angstrom units. The photoconductive composition is disposed on a conductive substrate and then charged to +800 volts, selectively exposed as described at page 3 of the specification last full paragraph and then developed with a black colorant in a styrene butylmethacrylate copolymer toner. The electrophotographic plate is then again recharged to about +800 volts and developed with a red colorant in the same resin. A two color print of the original is thus obtained.

EXAMPLE II

Selenium is doped with tellurium to enhance red sensitivity as in Example I. This photoconductive composition is disposed on an aluminum conductive substrate and charged, exposed and developed as in Example I with the exception that a blue toner is used in the first development step and a red toner in the second development step. A two color reproduction of the original is thereby obtained.

EXAMPLE III

A procedure as outlined in Example II is again performed with the exception that the selenium photoconductor is doped with bismuth.

EXAMPLE IV

An arsenic doped selenium photoconductive composition is disposed on an aluminum substrate, charged and exposed as in Example I, except that a black liquid developer composition is applied in the first development step, the electrophotographic plate is then again charged and a red light developer is applied to result in a two color reproduction of the original.

Although the present examples were specific in terms of conditions and materials used, any of the above listed typical materials may be substituted when suitable in the above examples with similar results. In addition to the steps used to carry out the process of the present invention, other steps or modifications may be used if desirable. For example, a soaking step wherein the surface of the photoconductive layer is given preliminary soaking in a high insulating liquid, may be provided between the steps of exposing the uniformity charged photoconductive surface to an illumination pattern, thereby producing an electrostatic latent image; and developing the electrostatic latent image through a liquid development process. Further, in the case of liquid development, the surface of the photoconductive layer may be rinsed by a highly insulating liquid between the developing and recharging steps or after the second developing step. In addition, other materials may be incorporated in the system of the present invention which will enhance, synergize or otherwise desirably affect the properties of the systems for their present use.

Anyone skilled in the art will have other modifications occur to him based on the teachings of the present invention. These modifications are intended to be encompassed within the scope of this invention.

What is claimed is:

1. A xerographic color reproduction process comprising providing a sensitized electrophotographic plate such that the inherent photosensitivity of the unsensitized photoconductor is extended resultng in the sensitized photoconductor having light fatigue properties within the inherent photosensitive range and no light fatigue properties within the extended photosensitive range, charging said photoconductor, selectively illuminating said photoconductor to color images with light having wavelengths both in the inherent and extended photosensitive range of the sensitized photoconductor resulting in an electrostatic charge pattern in the unilluminated areas, developing said electrostatic charge pattern with a toner of one color, recharging said electrophotographic plate to thereby charge the areas illuminated only in said extended range and not developed by said toner, and developing said recharged areas with toner of another color.

2. The process as defined in claim 1 wherein the sensitized photoconductive composition is selenium doped with one member selected from the group consisting of arsenic, antimony, bismuth and tellurium.

3. The process as defined in claim 1 wherein a black toner is used in the first developing step and a red toner is used in a second developing step.

4. The process as defined in claim 1 wherein a blue toner is used in the first developing step and a red toner is used in a second developing step.

* * * * *